United States Patent [19]

Yunan

[11] Patent Number: 4,776,276

[45] Date of Patent: Oct. 11, 1988

[54] CAST EXPLOSIVE PRIMER INITIATABLE BY LOW-ENERGY DETONATING CORD

[75] Inventor: Malak E. Yunan, Boonton Township, Morris County, N.J.

[73] Assignee: ETI Explosives Technologies International Inc., Wilmington, Del.

[21] Appl. No.: 46,538

[22] Filed: May 6, 1987

[51] Int. Cl.[4] ..... F42B 3/10; C06C 5/04

[52] U.S. Cl. ..... 102/275.5; 102/275.4; 102/275.7; 102/275.12; 102/318

[58] Field of Search ..... 102/275.2–275.7, 102/275.12, 313, 314, 318

[56] References Cited

U.S. PATENT DOCUMENTS

| | | | |
|---|---|---|---|
| Re. 30,621 | 5/1981 | Calder et al. | 102/275.7 X |
| 3,747,527 | 7/1973 | Griffith | 102/318 |
| 4,165,691 | 8/1979 | Bowman et al. | 102/275.7 X |
| 4,295,424 | 10/1981 | Smith et al. | 102/275.6 X |
| 4,383,484 | 5/1983 | Morrey | 102/275.7 X |
| 4,425,849 | 1/1984 | Jorgenson | 102/275.12 |
| 4,637,312 | 1/1987 | Adams et al. | 102/275.12 |

*Primary Examiner*—David H. Brown
*Attorney, Agent, or Firm*—Diamond C. Ascani

[57] ABSTRACT

An explosive primer unit in which the degree of energy coupling between a low-energy detonating cord (LEDC) and an explosive coupling element in a cast explosive primer is maximized; the unit contains (a) a substantially cylindrical charge of cast explosive having a perforation therein aligned substantially parallel to the charge's cylindrical axis, and sized to slidably receive a length of LEDC and (b) embedded in the cast explosive charge along the LEDC-receiving perforation, an explosive coupling element containing a shock-sensitive high-velocity detonating explosive having a tubular body having a wall that surrounds, and a bore that forms, the LEDC-receiving perforation over at least a portion of the perforation's length, the size of the bore of the coupling element's tubular body that forms the LEDC-receiving perforation in the cylindrical charge of cast explosive closely matching the outer diameter of a length of LEDC to be received therein.

17 Claims, 1 Drawing Sheet

CAST EXPLOSIVE PRIMER INITIATABLE BY LOW-ENERGY DETONATING CORD

BACKGROUND OF THE INVENTION

1. Field of the Invention

The present invention relates to a cast explosive primer adapted to be initiated instantaneously by low-energy detonating cord (LEDC), and to an assembly of an LEDC downline with the primer for initiating a cap-insensitive explosive in a borehole.

2. Description of the Prior Art

Low-energy detonating cord (LEDC), which may have an explosive core loading of only about 0.2 to 2 grams per linear meter of cord length, is widely used in non-electric explosive initiation systems in cases in which the noise and high brisance of heavier cords must be avoided. When used heretofore in conjunction with high-energy primers to initiate cap-insensitive explosives in boreholes, LEDC downlines have been used with primer or booster units containing a percussion-actuated detonator, e.g., in the delay booster assembly described in U.S. Pat. No. 3,709,149, issued Jan. 9, 1973, to H. E. Driscoll. U.S. Pat. No. 4,718,345 describes a primer assembly which includes a percussion-actuated detonator seated in a cavity in a high-energy primer, and an explosive coupler for explosively coupling the detonator to LEDC which is to be threaded through a perforation in the primer. This assembly, when incorporating a delay detonator, can be used in an in-hole delay system for the delayed initiation of deck-loaded explosive charges with high-energy delay primers strung on a single LEDC downline.

For the instantaneous initiation of a primer by an LEDC downline, co-pending, co-assigned U.S. patent application Ser. No. 035,004, filed Apr. 6, 1987, describes a primer unit requiring no detonator while relying only on an external arming element to achieve reliable initiation of the primer explosive by the low-energy cord. The arming element, i.e., an explosive coupler containing a charge of granular detonating explosive, is attached to a preferably recessed end surface of the primer and is manually disengageable therefrom. The explosive charge is linearly arrayed perpendicular to the cord and, at least at the end adjacent to the cord, is sufficiently shock-sensitive as to pick up the detonation from the low-energy cord, while boosting the energy level of the detonation to initiate the explosive compound in the adjacent primer.

SUMMARY OF THE INVENTION

The present invention provides an explosive primer unit in which the degree of energy coupling between a low-energy detonating cord and an explosive coupling element in a cast explosive primer is maximized. The explosive primer unit of the invention comprises: (a) a substantially cylindrical charge of cast explosive having a perforation therein aligned substantially parallel to, and preferably substantially on, the charge's cylindrical axis, and sized to slidably receive a length of LEDC, e.g., an LEDC downline to be threaded therethrough; and (b) embedded in the cast explosive charge along the LEDC-receiving perforation, an explosive coupling element containing a shock-sensitive high-velocity detonating explosive, e.g., pentaerythritol tetranitrate (PETN), and comprising an essentially tubular body having a wall that surrounds, and a bore that forms, the LEDC-receiving perforation over at least a portion, e.g, at least about 5%, of the perforation's length, the size of the bore of the coupling element's tubular body that forms the LEDC-receiving perforation in the cylindrical charge of cast explosive closely matching the outer diameter of a length of LEDC to be received therein. The coupling element may be a tubular extruded or pressed explosive, or a packaged powdered explosive arrayed so as to form a tube, e.g., a powder-enclosing elastomeric package such as a balloon spirally wrapped around the outer surface of a thin-walled tubular support body, or a powderenclosing pouch wrapped around all or a portion of the outer surface of a tubular support body. When an LEDC downline is threaded through the perforation in the primer unit, the cord is in contact with the coupling element, i.e., with the wall of the tubular element, by virtue of the fact that the coupling element is embedded in the primer along the LEDC-receiving perforation and also because the cord-/coupler contact is assured by the tailoring of the coupling element's bore size to the LEDC size. This contact assures good energy coupling.

BRIEF DESCRIPTION OF THE DRAWING

In the accompanying drawing, which illustrates specific embodiments of the primer unit and cord/primer assembly of the invention.

DETAILED DESCRIPTION

The primer unit of the invention contains a high-energy explosive primer, i.e., a substantially cylindrical charge of cast explosive, e.g., a cast mixture of PETN and TNT, generally lightly wrapped with paper or cardboard, optionally end-capped, or held in a plastic container. The primer contains a cord tunnel, usually an axial perforation extending from one end of the primer to the other, and an explosive coupling element in the form of a tube or perforated cylinder or disk is embedded in the cast explosive along at least a portion of the cord tunnel. Accordingly, the wall of the tubular coupling element surrounds the cord tunnel, and the bore of the tubular coupling element itself forms the cord tunnel, in the portion of the cord tunnel's length along which the explosive coupling element lies.

Figure 1:
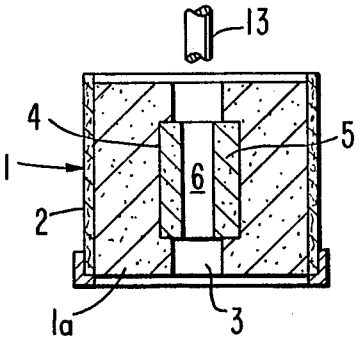
Figure 1A:
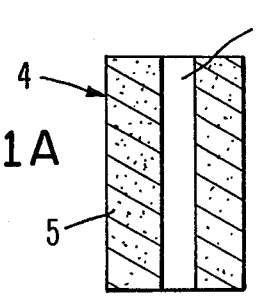

In the primer unit shown in FIG. 1, 1 is a cast primer, i.e., a substantially cylindrical charge of cast explosive 1*a*, having a light peripheral wrap 2, e.g., a cardboard tube into which explosive 1*a* has been cast. Primer 1 has an axial bore or perforation 3 therethrough. Coupling element 4 (FIG. 1A) is embedded in cast charge 1*a* along a portion of perforation 3. Element 4 is a tubular body whose wall 5 is made, for example, of a shock-sensitive extruded mixture of a high-velocity detonating explosive and an elastomeric binder. A typical extruded mixture is one which contains at least about 60 percent superfine PETN. When element 4 is in place in primer 1, wall 5 of coupling element 4 surrounds perforation 3, and bore 6 becomes a portion of perforation 3 itself. Bore 6 is sized to allow a low-energy detonating cord 13 to be threaded through while remaining in contact with the adjacent wall.

Figure 4:
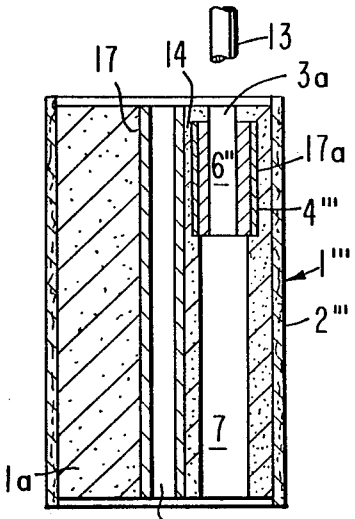
FIGS. 2 and 4 are cross-sectional views of two primer units of the invention wherein the tubular coupling element is embedded in a cast explosive charge adapted for initiation by a detonating cord or, alternatively, a detonator, the coupling element in this primer being embedded along a perforation that extends an off-axis cavity (for the seating of a detonator when desired) to the opposite end of the primer, a length of LEDC being threaded through the off-axis cavity and extension when the primer is to be initiated by LEDC via the coupling element.
Figure 2:
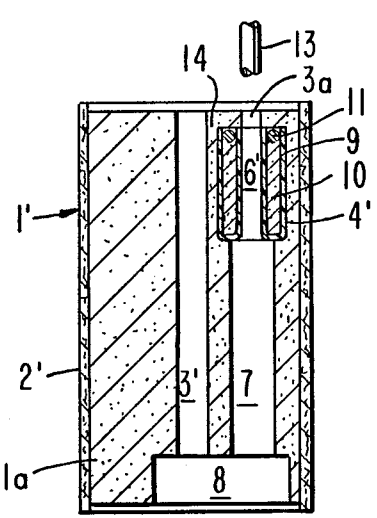

The FIGS. 2 and 4 primer units are also provided with an off-axis cavity 7, which allows the units to be initiated by a detonator as an alternative to initiation by LEDC. The FIG. 2 unit also has a block-like recess 8 adjacent perforation 3' and cavity 7 for accommodating an explosive coupler as described in the aforementioned U.S. Pat. No. 4,718,345. Coupling element 4 is embedded in cast charge 1*a* along perforations 3*a* which is a coaxial extension of cavity 7, allowing a length of LEDC 13 to be threaded through cavity 7 and bore 6' of element 4'. Perforation 3*a* and bore 6' are sized to match the outer diameter of LEDC 13, while cavity 7 is larger in diameter as required to accommodate a detonator. When the units are to be used for instantaneous initiation by LEDC, the latter is threaded through bore 6' and cavity 7. In the alternative embodiment wherein the primer is to be initiated by a delay detonator seated in cavity 7, perforation 3' is used for threading the wires or cord supplying the actuation impulse to the detonator.

If perforation 3' and 3''' in the FIGS. 2 and 4 unit is to be threaded with an LEDC for the delay initiation of the primer by a detonator in cavity 7, the portion 14 of cast charge 1*a* between coupling elements 4' and 4''' the and LEDC in perforations 3' and 3''' needs to be sufficiently wide that accidental initiation of coupling elements 4' and 4''' by the LEDC and accidental instantaneous initiation of the primer (thus by-passing the intended functioning of the delay detonator) does not occur. Portion 14 may be of the same composition as charge 1*a*. A liner 17 in perforation 3''' and/or a thick wall 17*a* on coupling element 4''' may be used to assure the delay functioning also.

Figure 2A:
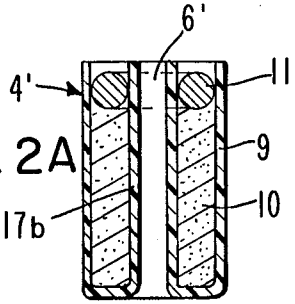

In the primer unit shown in FIG. 2, coupling element 4' (FIG. 2A) is a double-walled shell 9 made, for example, of metal or plastic, and having a bore 6'. A shock-sensitive high-velocity detonating explosive powder, e.g., PETN or RDX, 10, is loaded into the annular space between the walls of shell 9, and an annular plug 11 seals the end of shell 9 closed. Wall 17*b* is thin enough to allow initiation of explosive powder 10 by LEDC 13. Double walled shell 9 may also be of molded plastic.

Figure 3:
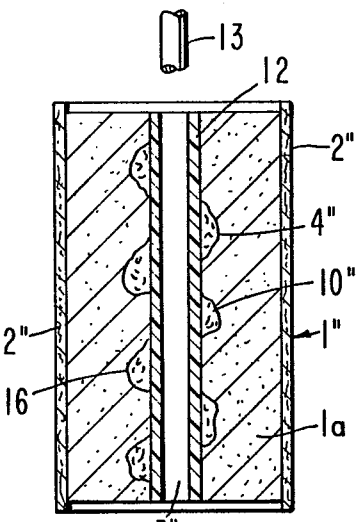
FIGS. 1 and 3 are cross-sectional views of the two primer units of the invention wherein the tubular coupling element is embedded in the cast explosive charge along an axial LEDC-receiving perforation.

In the embodiment shown in FIG. 3, coupling element 4'' (FIG. 3A) comprises a shock-sensitive high-velocity detonating explosive powder, e.g., PETN, RDX, and nitromannite 10'', enclosed within an elongatable elastomeric package, such as a balloon, 16. The balloon is wrapped spirally around a thin-walled tubular support body, e.g., a plastic straw, 12, which has an inner diameter chosen to closely match the outer diameter of an LEDC 13 to be threaded through the primer. Straw 12 serves to confer the tubular configuration on coupling element 4'' and is needed to be at least as long as the axial length of the spiral to prevent collapsing of the spiral and closing of bore 3''.

For convenience of manufacture, it may be desirable to have straw 12 longer than the axial length of the balloon spiral, e.g., so that the straw lines the entire length of perforation 3''. Balloon 16 may be a preformed plastic pouch which is heat-sealed after filling with explosive 10 and then wrapped around straw 12. For the case of a flexible balloon or pouch, total wrapping around the straw may be difficult, therefore spiral wrapping is desirable as shown in FIG. 3. Although full enclosure of the cord tunnels 6, 6', 6'', and 6''' by any of the couplers 4, 4', 4'', and 4''' described above is desirable, this may not be necessary when cord output is sufficiently high with respect to the sensitivity of the coupler explosive and a half circumferential wrap around bore 6, 6', 6'', or 6''' or cord 13 is sufficient in many cases.

A source of water leak into balloon 16 may be knot 18, or in the case of a heat-sealed pouch, the line of seal of the pouch itself. Once water enters such structures, explosive 10'' may be desensitized depending on the amount of water, and the level of energy of the LEDC. Such seepage may be stopped if knot 18 is dipped in a sealing binder or compound or in molten wax or tar, or such sealants are coated over the inner walls of the balloon before knotting or repellents are added to the explosive powder 10'' before filling in the balloon.

It is to be understood that any of the above-described coupling elements may be used with any primer as long as bore 6' 6'', 6''' is closely matched with the LEDC outer diameter and the coupling element surrounds at least a portion of the LEDC and occupies a portion 3, 3', 3'' or 3'''.

Figure 3A:
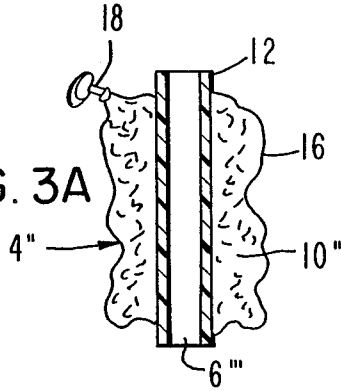
FIGS. 1A, 2A, and 3A are cross-sectional views of the explosive coupling elements employed in the primer units shown in FIGS. 1, 2, 3, and 4.

By way of example, a primer unit was made from a 50/50 PETN/TNT (Pentolite) mixture and an explosive coupling element 4'' shown in FIG. 3A of a balloon filled with about 5 g of PETN. The balloon was spirally wound around a plastic straw, 3.3 mm O.D. and 2.9 mm I.D. The Pentolite was cast around the balloon set coaxially in a cardboard sleeve about 5 cm high and 7.5 cm in diameter. A 0.5 g/m PETN basis LEDC cord was threaded in the cord tunnel made by the straw, and the LEDC was detonated. The LEDC detonated the booster at a velocity of 6600 meters/sec via the coupling balloon.

Coupling elements made with 70 to 99% PETN and the balance a binder, a plasticizer or a water repellent were initiated reliably with LEDC of 2 g/m and lower, and primer units made with such elements are useful products of this invention.

The present primer unit is used in those situations wherein a cast primer explosive is insufficiently sensitive as to be initiated by a low energy or mild detonating cord of a selected explosive core loading. In most instances the explosive core loading will be up to about 2 g/m. However, with less sensitive cast primers, the embedded explosive coupling element may be advantageously used even with cord of slightly higher loading, for example, up to about 4 g/m; and it is to be understood that such cords fall within the meaning of the term LEDC where it is used herein to define the cord in the example of the invention. On this basis the diameter of the cord receiving perforation in the coupler of the present primer unit will be up to about 6 mm.

A preferred cord for initiating the primer unit is one described in U.S. Pat. No. 4,232,606, the disclosure of which is incorporated herein by reference. This cord has a solid core of a deformable bonded detonating explosive composition comprising a crystalline high explosive compound, preferably superfine PETN, admixed with a binding agent. The cord described in U.S. Pat. No. 3,125,024 also can be used, e.g., in a granular PETN core loading of about 0.8 to 3.0 g/m.

The cast primer units of the invention can be made by casting the primer explosive into a cardboard tube 2 which is seated on a base plate to which a metal pin is affixed (to produce perforation 3). Tubular coupling element 4 is positioned on the pin, and remains embedded in the cast explosive after the solidified primer is removed from the pin.

I claim:

1. An assembly for initiating a cap-insensitive explosive in a borehole comprising:

(a) an explosive primer unit comprising a substantially cylindrical charge of cast explosive having a perforation lying substantially on or parallel to the charge's cylindrical axis and extending from one end of the charge to the other, and, embedded in said cast explosive charge along said perforation, an explosive coupling element containing a shock-sensitive high-velocity detonating explosive, said coupling element comprising an essentially tubular body having a wall that surrounds, and a bore that forms, said perforation over at least a portion of the perforation's length, and (b) an LEDC down line having an explosive core loading of up to about 3 grams per linear meter of cord length threaded through said perforation in contact with said coupling element.

2. An assembly of claim 1 wherein said tubular body is a pressed mixture of an explosive powder, a binder, and a water repellant.

3. An assembly of claim 2 wherein said pressed mixture contains about 70 to 99 percent of at least one member of the group consisting of PETN, RDX, and nitromannite.

4. An assembly of claim 1 wherein said coupling element comprises a shock-sensitive high-velocity detonating explosive powder sealed within a package.

5. An assembly of claim 4 wherein said LEDC down line is in contact with the inside wall of a sealed double-walled metal or plastic tubular container housing an annular charge of said explosive powder.

6. An assembly of claim 1 wherein said tubular body is an extruded mixture of pentaerythritol tetranitrate (PETN) or cyclotrimethylenetrinitramine (RDX) and an elastomeric binder.

7. An assembly of claim 6 wherein said extruded mixture contains at least about 60 percent superfine PETN.

8. An assembly of claim 6 wherein the wall of said tubular body surrounds, and its bore forms, said LEDC-receiving perforation over at least about 5 percent of the perforation's length.

9. An explosive primer unit adapted to be initiated instantaneously by low-energy detonating cord (LEDC) and comprising:

(a) a substantially cylindrical charge of cast explosive having a perforation therein aligned substantially on or parallel to the charge's cylindrical axis and sized to slidably receive a length of LEDC; and (b) embedded in said cast explosive charge along said LEDC-receiving perforation, an explosive coupling element comprising a shock-sensitive high-velocity detonating explosive powder sealed within a package, said coupling element comprising an essentially tubular body having a wall that surrounds, and a bore that forms, said LEDC-receiving perforation over at least a portion of the perforation's length, the diameter of the bore of said tubular body that forms said LEDC-receiving perforation being up to about 0.6 centimeter.

10. An explosive primer unit of claim 9 wherein said coupling element is present along said perforation over at least about 5 percent of the perforation's length.

11. An explosive primer unit of claim 9 wherein said perforation lies substantially on the charge's cylindrical axis and extends from one end of the charge to the other.

12. An explosive primer unit of claim 9 wherein said coupling unit is a tubular film package formed by wrapping a flat package containing said explosive powder around a mandrel.

13. An explosive primer unit of claim 9 wherein said explosive powder is of at least one member of the group consisting of PETN, RDX, and nitromannite.

14. An explosive primer unit of claim 9 wherein said coupling element comprises a sealed double-walled tubular container housing an annular charge of said explosive powder.

15. An explosive primer unit of claim 14 wherein said container is made of metal or plastic.

16. An explosive primer unit of claim 9 wherein said coupling element comprises a shock-sensitive high-velocity detonating explosive powder enclosed within an elongated elastomeric package, said package being of fixed array surrounding the outer surface of a thin-walled, tubular support body.

17. An explosive primer unit of claim 16 wherein said package is affixed in spiral array to the outer surface of a thin-walled tubular support body.

* * * * *